US011639663B2

(12) United States Patent
Teuchgraber et al.

(10) Patent No.: US 11,639,663 B2
(45) Date of Patent: May 2, 2023

(54) REGULATING FLOW TO A MUD PULSER

(71) Applicant: Baker Hughes Holdings LLC, Houston, TX (US)

(72) Inventors: Jens Teuchgraber, Hannover (DE); Thomas Wettmarshausen, Hannover (DE); Bastian Sauthoff, Burgdorf (DE); Arne Deiters, Celle (DE)

(73) Assignee: BAKER HUGHES HOLDINGS LLC, Houston, TX (US)

( * ) Notice: Subject to any disclaimer, the term of this patent is extended or adjusted under 35 U.S.C. 154(b) by 0 days.

(21) Appl. No.: 17/070,779

(22) Filed: Oct. 14, 2020

(65) Prior Publication Data

US 2021/0115788 A1 Apr. 22, 2021

Related U.S. Application Data

(60) Provisional application No. 62/916,092, filed on Oct. 16, 2019.

(51) Int. Cl.

| | |
|---|---|
| ***E21B 47/18*** | (2012.01) |
| ***E21B 47/24*** | (2012.01) |
| ***E21B 33/12*** | (2006.01) |

(52) U.S. Cl.

CPC ..... *E21B 47/18* (2013.01); *E21B 33/12* (2013.01)

(58) Field of Classification Search

None

See application file for complete search history.

(56) References Cited

U.S. PATENT DOCUMENTS

| | | | |
|---|---|---|---|
| 3,983,948 | A | 10/1976 | Jeter |
| 5,055,837 | A | 10/1991 | Abdallah et al. |
| 5,205,689 | A | 4/1993 | Fischer |
| 5,510,582 | A | 4/1996 | Birchak et al. |
| 5,787,052 | A | 7/1998 | Gardner et al. |
| 6,219,301 | B1 | 4/2001 | Moriarty |
| 6,920,085 | B2 | 7/2005 | Finke et al. |
| 6,975,244 | B2 | 12/2005 | Hahn et al. |

(Continued)

FOREIGN PATENT DOCUMENTS

EP 2647791 A2 10/2013

OTHER PUBLICATIONS

PCT Search Report dated Jan. 29, 2021, in the prosecution of patent application No. PCT/US2020/056071, 8 pages.

*Primary Examiner* — Curtis A Kuntz
*Assistant Examiner* — Jerold B Murphy
(74) *Attorney, Agent, or Firm* — Bracewell LLP; Keith R. Derrington

(57) ABSTRACT

A velocity of a flow of drilling fluid is adjusted to a magnitude that is within the operating range of a mud pulser disposed in the flow of the drilling fluid. A stator in the mud pulser directs the flow of drilling fluid along one or more separate paths. The paths are defined by channels that extend axially along an outer surface of the stator and that are spaced angularly apart from one another. Also in the mud pulser is a rotor that alternatingly blocks the paths. The velocity is adjusted with a plug assembly that blocks flow through a designated channel. One type of plug assembly is a disk with passages that register with less than all of the channels, and that mounts on a downstream end of the stator. Other types of plug assemblies mount in the designated channel to block the flow path.

18 Claims, 10 Drawing Sheets

(56) References Cited

U.S. PATENT DOCUMENTS

| | | | | |
|---|---|---|---|---|
| 7,138,929 | B2 | 11/2006 | Jeffryes et al. | |
| 8,693,284 | B2 | 4/2014 | Allan et al. | |
| 9,133,664 | B2 | 9/2015 | Macdonald et al. | |
| 9,371,714 | B2 | 6/2016 | Tubel | |
| 9,624,767 | B2 | 4/2017 | Sitka et al. | |
| 2013/0076527 | A1* | 3/2013 | Sitka | G01V 11/002 340/854.4 |
| 2016/0040529 | A1* | 2/2016 | Sitka | E21B 47/24 367/84 |
| 2016/0245078 | A1 | 8/2016 | Mahmoud et al. | |
| 2017/0074092 | A1 | 3/2017 | Pogrebinsky et al. | |
| 2017/0183945 | A1 | 6/2017 | Tolman et al. | |
| 2017/0260853 | A1 | 9/2017 | Stack et al. | |
| 2018/0179890 | A1* | 6/2018 | Huber | E21B 34/08 |
| 2018/0371901 | A1* | 12/2018 | Lakings | E21B 7/06 |

* cited by examiner 52A
44A
70A
72A
LB
ASA
56A
DM
72B
70B 58B
52B
56B
60B
ASB
44B
70C
72C
58C
72C
HB
LB
56C
60C
44C
ASC

REGULATING FLOW TO A MUD PULSER

CROSS REFERENCE TO RELATED APPLICATION

This application claims priority from U.S. Provisional Application Ser. No. 62/916,092 filed Oct. 16, 2019 the full disclosure of which is incorporated by reference herein in its entirety and for all purposes.

BACKGROUND OF THE INVENTION

1. Field of Invention

The present disclosure relates to communicating downhole and uphole with pressure pulses in a flow of drilling fluid. More specifically, the present disclosure relates to regulating a flow of drilling mud to a mud pulser.

2. Description of Prior Art

One type of measurement while drilling ("MWD") senses conditions within the wellbore, and transmits data representing the sensed conditions to surface. One type of data sensed is the inclination and azimuth of the wellbore being formed. Mud pulse telemetry is one way to transmit the data from within the wellbore to surface, and where pressure pulses (commonly referred to as mud pulses) are generated within drilling fluid in a drill string. The mud pulses are monitored by sensors disposed in a flow of the drilling fluid returning to surface. Decisions for steering the drill bit are often based on information obtained from decoding the monitored mud pulses.

Mud pulses (also referred to as pressure pulses) are typically generated with mud pulsers that are disposed within the drill string and in the path of drilling fluid flowing through the drill string. One well known manner of producing mud or pressure pulses is to selectively alter the cross sectional area of the drilling fluid flow path with internally located valves. The valves typically employ a reciprocating piston or a rotating shear valve. Mud pulsers with either type of valve are operable within a limited range of drilling fluid flowrate, and are sometimes ineffective above or below certain flowrates.

SUMMARY OF THE INVENTION

Disclosed is an example of a system for use in wellbore operations having a drill string, and a mud pulser in the drill string. The mud pulser includes a stator having an outer surface with one or more channels that project along an axis of the drill string and that are spaced angularly apart from one another about the axis of the drill string, a rotor having one or more slots that selectively move into and out of registration with outlets of the channels with rotation or oscillation of the rotor, and a plug assembly that selectively defines a barrier to a flow of the drilling fluid through a designated channel. The plug assembly may selectively define either a total or partial barrier to the flow of the drilling fluid through the designated channel. When the plug assembly defines a total barrier to the flow of drilling fluid through a designated channel, the drilling fluid flowing through the one or more channels other than the designated channel is at a velocity of sufficient magnitude to generate pressure pulses in the drilling fluid by selectively moving the one or more slots into and out of registration with the one or more outlets. When the plug assembly defines a partial barrier to the flow of drilling fluid through the only channel of the stator, the drilling fluid that can still flow through the channel is at the velocity of sufficient magnitude. When the plug assembly defines a partial barrier to the flow of drilling fluid through a designated channel and the stator has multiple channels, the drilling fluid that can still flow through the designated channel together with the drilling fluid flowing through the one or more channels other than the designated channel is at the required velocity. The plug assembly optionally includes a disk having slots that register with less than all of the channels. In one example the plug assembly includes an elongated body that is disposed axially the designated channel. An opening is optionally provided that extends axially through the body. In an alternative, the opening defines a passage through which drilling fluid flows. The opening optionally defines a bore that selectively receives a fastener. In an embodiment, the fastener engages a receptacle formed in the channel and the plug assembly further includes an annular stop sleeve circumscribing the fastener and coupled to the body, and a C-ring coupled to the fastener between the stop sleeve and receptacle, so that when the fastener is uncoupled and pulled away from the receptacle, the body is removable from the channel by interfering contact of the C-ring with the stop sleeve. A cross sectional area of the body can vary with respect to a length of the body. In one embodiment, the plug assembly is laterally expandable into sealing contact with the channel. In an example embodiment, the plug assembly includes spaced apart leaf members, a wedge that is selectively drawn into a space between the leaf members, and a fastener coupled with the wedge and the leaf members. Optionally included in the system is a sensor in communication with the drilling fluid that monitors pressure pulses in the drilling fluid, and a controller in communication with the sensor.

An alternate example of a system for use in wellbore operations is described and that includes a stator selectively disposed in a path of fluid flowing in a drill string with a body having an outer surface with axially extending channels that are spaced apart from one another, a rotor having slots that selectively register and unregister with the channels, and a plug assembly for regulating a flow of the fluid to a velocity having a magnitude sufficient so that pressure pulses generated in the fluid from interaction between the fluid and the slots are at a magnitude so that the pressure pulses are detectable. The system optionally further includes a sensor in communication with the fluid downstream of the stator and rotor, and that selectively detects the pressure pulses. In one example, a flowrate of the fluid is at a magnitude so that a pressure pulse is not detectable that is generated by fluid flowing past the stator and rotor at a velocity without the plug assembly.

An example method of wellbore operations is also disclosed, and that includes flowing fluid within a wellbore, generating a pressure pulse in the flowing fluid that is at a threshold level of detection by controlling a velocity of the fluid in which the pressure pulse is being generated, and detecting the pressure pulse. Embodiments exist where the step of generating a pressure pulse includes introducing a localized pressure increase in the fluid by blocking a flow of the fluid for a discrete time period. Optionally included with the method is encoding data into the fluid by generating a plurality of pressure pulses in the flowing fluid. Controlling a velocity of the fluid optionally includes reducing a cross sectional area of the flowing fluid.

BRIEF DESCRIPTION OF DRAWINGS

Some of the features and benefits of the present invention having been stated, others will become apparent as the description proceeds when taken in conjunction with the accompanying drawings, in which.

Figure 1:
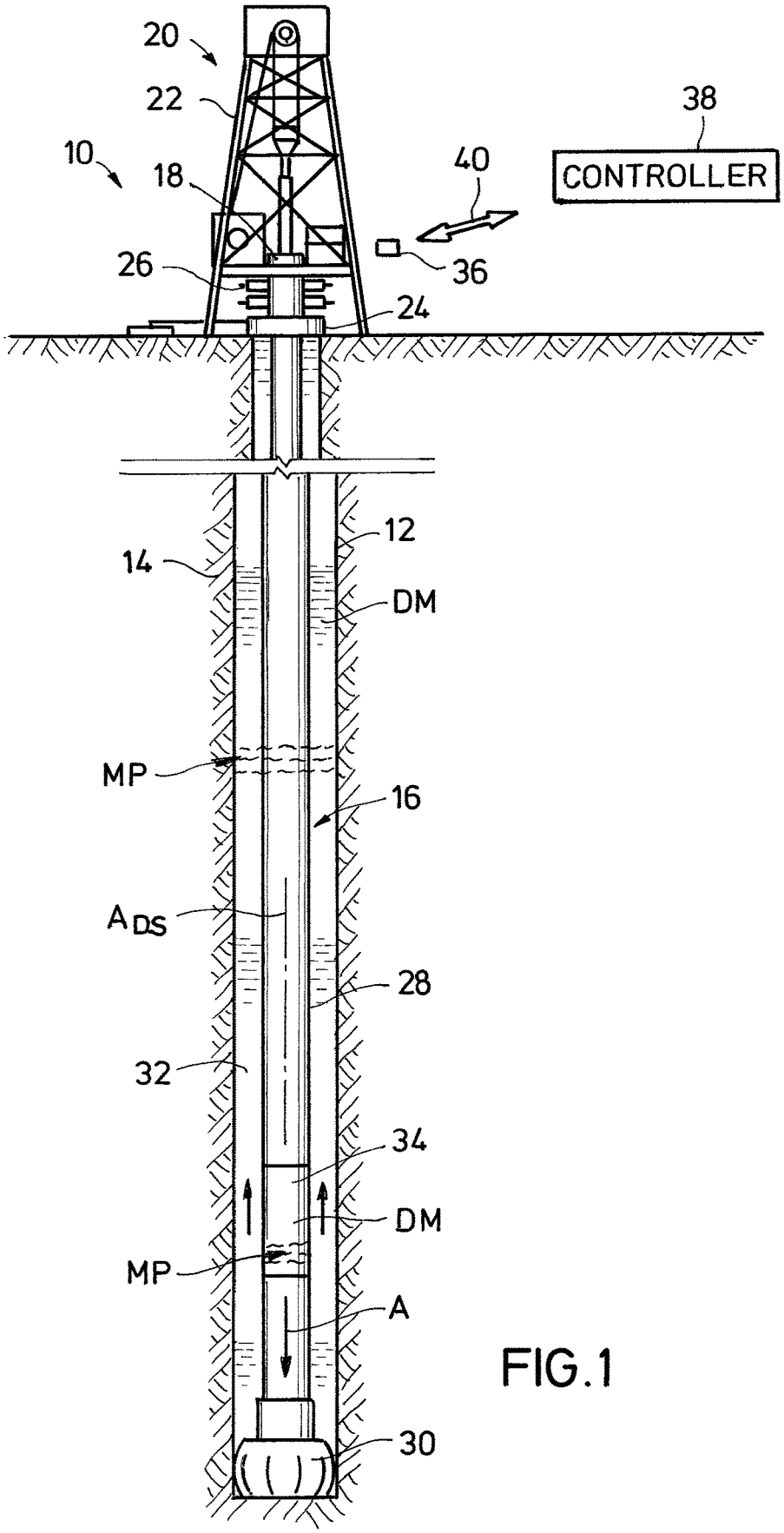
FIG. 1 is a partial side sectional view of an example of a wellbore being formed with a drilling system having a mud pulser.

While the invention will be described in connection with the preferred embodiments, it will be understood that it is not intended to limit the invention to that embodiment. On the contrary, it is intended to cover all alternatives, modifications, and equivalents, as may be included within the spirit and scope of the invention as defined by the appended claims.

DETAILED DESCRIPTION OF INVENTION

The method and system of the present disclosure will now be described more fully hereinafter with reference to the accompanying drawings in which embodiments are shown. The method and system of the present disclosure may be in many different forms and should not be construed as limited to the illustrated embodiments set forth herein; rather, these embodiments are provided so that this disclosure will be thorough and complete, and will fully convey its scope to those skilled in the art. Like numbers refer to like elements throughout. In an embodiment, usage of the term "about" includes +/−5% of the cited magnitude. In an embodiment, usage of the term "substantially" includes +/−5% of the cited magnitude. In an embodiment, usage of the term "generally" includes +/−10% of the cited magnitude.

It is to be further understood that the scope of the present disclosure is not limited to the exact details of construction, operation, exact materials, or embodiments shown and described, as modifications and equivalents will be apparent to one skilled in the art. In the drawings and specification, there have been disclosed illustrative embodiments and, although specific terms are employed, they are used in a generic and descriptive sense only and not for the purpose of limitation.

Shown in a partial side sectional view in FIG. 1 is an example of a drilling system 10 forming a wellbore 12 in a formation 14. A drill string assembly 16 is included with drilling system 10, and which is rotated by a drive system 18 depicted mounted on a surface rig 20 which is outside of wellbore 12. For the purposes of discussion, an axis $A_{DS}$ of the drill string 16 is represented that extends along a length of drill string 16. A derrick 22 is included with surface rig 20 and which mounts over an opening to wellbore 12. A wellhead assembly 24 mounts over wellbore 12 and provides pressure control of fluids within wellbore 12. Illustrated on an upper surface of wellhead assembly 24 is a blowout preventer ("BOP") 26. Drill string 16 is made up of a length of drilling collars or joints threaded together to form an elongated pipe string 28. In this example, an upper end of pipe string 28 is disposed in a bore that axially intersects BOP 26. A drill bit 30 is on a lower end of pipe string 28, and when forced into rotation against the formation 14 excavates rock and other materials making up the formation to form the wellbore 12.

Drilling fluid, which for the purposes of illustration herein is also referred to as drilling mud DM, is introduced into the pipe string 28. In the example of FIG. 1, drilling mud DM exits from nozzles (not shown) on a lower surface of drill bit 30, and recirculates back to surface within an annulus 32 between the pipe string 16 and sidewalls of the wellbore 12. Optional functions provided by the drilling mud DM include pressure control in the formation 14, cooling of the drill bit 30, and removing cuttings (not shown) that result from excavating within formation 14. Integrated within the pipe string 28 is a measurement while drilling ("MWD") module 34, which in a non-limiting example of operation and as described in more detail below generates mud pulses MP in the drilling mud DM that travel uphole with the drilling mud DM flowing upward in annulus 32 to surface. As described in more detail below, in an example the mud pulses MP are generated by fluctuating pressure at a location or locations in the wellbore 12 and the mud pulses MP that propagate in the drilling mud DM are subsequently sensed at a different location or locations. In an embodiment, the mud pulses MP are at or above a designated magnitude detectable by a sensor 36. Examples of placement of the sensor 36 include locations that are in communication with the drilling mud DM; such as but not limited to the wellhead assembly 24, blowout preventer 26, and the string 16 (including portions inside and outside the wellbore 12 and above the blowout preventer 26).

In an embodiment, the drilling system 10 includes a controller 38, which is schematically illustrated outside the wellbore 12; and is in communication with sensor 36 via communication means 40. Optionally, controller 38 is in communication with other devices of drilling assembly 10 and also with that remote to the wellbore 12. In an example, controller 38 includes an information handling system (IHS); which optionally controls generation of pulses as well as controlling the subsequent recording of the pulses or signal(s) resulting from the pulses. In an embodiment, recorded data is stored in the IHS, and optionally in the IHS data is transformed into a readable format. Example locations of the IHS include at the surface, in the wellbore, or partially above and below the surface. Further optionally, the IHS includes a processor, memory accessible by the processor, nonvolatile storage area accessible by the processor, and logics for performing some or all of the steps above described. In an example of transmission to the surface data is encoded pursuant to a selected communication protocol. Examples of communication protocols for communicating data through a pulse series include frequency-shift keying ("FSK"), phase-shift keying ("PSK"), amplitude-shift keying ("ASK"), combinations of the above, and other known or later developed communication protocols.

Figure 2:
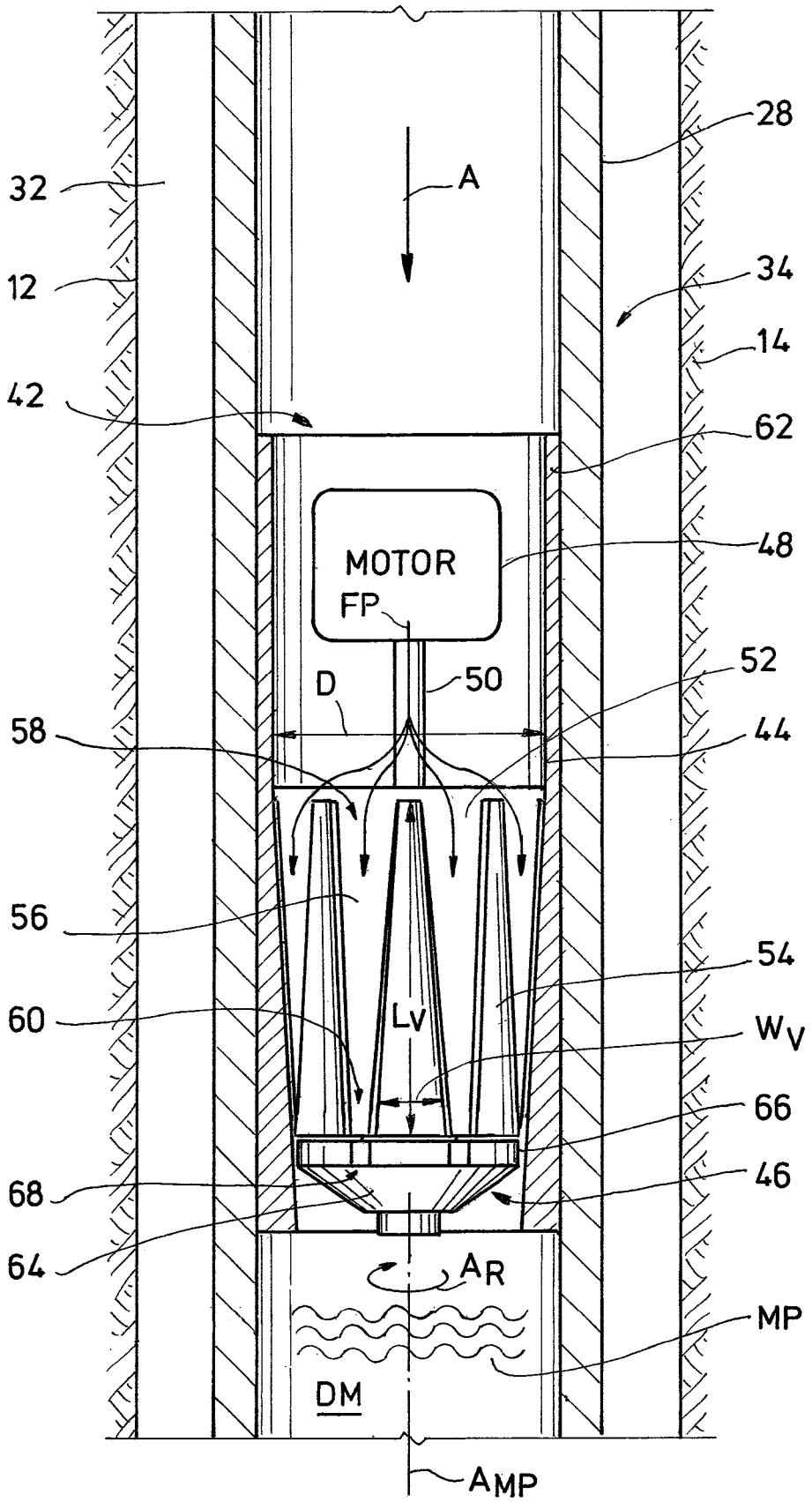
FIG. 2 is a side partial sectional view of an example of the mud pulser of FIG. 1.

Shown in a side partial sectional view in FIG. 2 is an example portion of the drill string 28 having the MWD module 34. In this embodiment a pulser assembly 42 is disposed within the MWD module 34 and which includes a stator 44 and rotor 46. Arrows A represent a direction of a flow of the drilling mud DM within the drill string 28 and in the annulus 32, and in the illustrated example the drilling mud DM reaches stator 44 before reaching rotor 46. For the purposes of discussion herein, a direction opposite that of arrows A is referred to as upstream, and in the direction of arrows A is referred to as downstream. Rotor 46 is selectively rotated about axis $A_{MP}$ and as reflected by arrow $A_R$. In the illustrated example, rotation of rotor 46 is provided by motor 48 which is schematically illustrated upstream of stator 44 and within string 28. In the example of FIG. 2, an elongated shaft 50 is shown having opposing ends respectively connected to the motor 48 and rotor 46 and provides a mechanical coupling between motor 48 and rotor 46; as shown a portion of shaft 50 is disposed within stator 44. In alternatives, motor 48 directly couples to rotor 46 either mechanically or electro-magnetically. Yet further alternatives exist in which rotor 46 is actuated by means such as mechanical, hydraulic, pneumatic, electrical, electro-magnetic, and combinations thereof.

Stator 44 of FIG. 2 includes a generally frusto-conical body 52, and which in an alternative is generally hollow within. Vanes 54 in this example are formed along an outer surface of body 52 with lengths $L_V$ that are aligned generally axially along the body 52. Widths $W_V$ of vanes 52 extend circumferentially around body 52. The vanes 54 also have thicknesses, shown oriented radially to the body 52. The widths $W_V$ increase with distance proximate to rotor 46. The vanes 54 are shown spaced apart angularly with respect to one another about a circumference of the body 52, and where channels 56 are defined between adjacent vanes 54. The channels 56 in this example also extend generally axially along the length of body 52, and whose widths are complementary to that of the vanes 54. A flow path FP is shown that schematically illustrates an example course or route of drilling mud DM flowing within the pipe string 28 and within the channels 56 intersecting the body 52, and in alternatives the flow path FP continues past the downhole or lower ends of the channels 56 distal from motor 48. In this example, the flow path FP is in an open configuration. In an alternate example stator 44 includes a single vane 54 and a single channel 56 intersecting the vane 54; in this alternate example a portion of a length of flow path FP is contained within the single channel 56. Embodiments exist with the one or more channels 56 of the stator 44 extending axially along and/or radially across the body 52. That in an example allows the drilling fluid to flow from an uphole to a downhole direction as indicated by arrow A. In a non-limiting example, the one or more channels 56 are in a twisted or helical configuration and extending radially as they extend axially. In a further non-limiting example, one or more channels 56 of the stator 44 extend axially, while other channels 56 extend both axially and radially. Inlets 58 are defined within the channels 56 proximate an end of stator 44 distal from rotor 46. Outlets 60 are defined within channel 56 at an end of stator 44 proximate to rotor 46. As the vanes 54 have increasing widths $W_V$ with distance proximate to rotor 46, the outlets 60 have widths that are less than those of the inlets 58. Alternate embodiments exist where the vanes 54, and thus channels 56 as well, have widths that are substantially constant along a length of the body 52, are undulating, or larger distal from rotor 46.

Further included in the example of FIG. 2 is an annular sleeve 62 shown circumscribing pulser assembly 42 and in close contact with an inner surface of the pipe string 28. In an example, a flow barrier is between sleeve 62 and string 28 so that all drilling mud DM flowing downhole within the string 28 flows through pulser assembly 42. In the illustrated example, a portion of the body 52 is frusto-conically shaped with a diameter D that narrows with distance from motor 48. Further illustrated in this example is that a thickness of the sidewall of sleeve 62 increases, which decreases the inner diameter of sleeve 62 to accommodate dimensional changes of body 52; and which maintains a close contact between the outer periphery of stator 44 with an inner surface of sleeve 62 along substantially an entire length of the stator 44. In an embodiment, sleeve 62 spans across the space between adjacent vanes 54 to define a flow barrier along the outer radial surface of the channels 56. Alternatively, sleeve 62 is in sealing contact with the outer radial surfaces of vanes 54 and all drilling mud DM flowing into each inlet 58 remains within the respective channel 56 until reaching the corresponding outlet 60.

Still referring to FIG. 2, rotor 46 of this example includes a rotor body 64 with a frusto-conical cross section, and an outer radial surface profiled oblique to axis $A_{MP}$ that depends towards stator 44 with distance from axis $A_{MP}$. Further included with rotor 46 is a planar base element 66 mounted on a side of rotor body 64 facing stator 44; as shown base element 66 is substantially perpendicular with axis $A_{MP}$. In an example, an outer diameter of the base element 66 is spaced radially inward from the outer circumference of the vanes 54. Slots 68 are shown formed axially through the outer periphery of the base element 66 at selected angular positions around the axis $A_{MP}$ of the pulser assembly 42. Rotating rotor 46 revolves or orbits slots 68 about axis $A_{MP}$ and into and out of registration with the outlets 60. In a non-limiting example of operation, rotating rotor 46 at a designated angular velocity moves slots 68 and outlets 60 in and out of registration with one another; and during the time when the outlets 60 are not in registration with slots 68, the drilling mud DM flowing through one or more of channels 56 is blocked by a portion or portions of the base element 66 disposed angularly between adjacent slots 68. In an embodiment, the blocking contact between the drilling mud DM and the solid portion of the base element 66 introduces a discreet and localized increase of pressure within the drilling mud DM that in turn generates one or more mud pulse MP in the drilling mud DM. Further in this example, strategically rotating rotor 46 generates mud pulses MP in the drilling mud DM that are of a designated length and/or sequence, where the sequence of mud pulses MP define signals that represent data. In another non-limiting example mud pulses MP are generated in the drilling mud DM by oscillating rotor 46; such as by rotating rotor 46 an angular distance about axis $A_{MP}$ in an angular direction (e.g. clockwise), then rotating rotor 46 another angular distance about axis $A_{MP}$ in a reverse angular direction (e.g. counter-clockwise), alternatives include the angular distances of the clockwise and counter-clockwise being the same or different and at differing angular velocities. Optionally mud pulses MP that are of a designated length and/or sequence is achieved by strategically oscillating rotor 46. Further non-limiting examples of the generation of mud pulses MP in the drilling mud DM that are of a designated length and/or sequence include strategically rotating rotor 46 in two directions, and alternatively at different speeds in one direction. In an embodiment of operation, data signals are encoded in the drilling mud DM by the mud pulses MP. In a further alternative to this example, the data signals are then monitored by sensor 36 (FIG. 1) to obtain information about the operation of the drilling assembly 10. Example data includes azimuth and/or orientation of the string 16, which in one example provides a basis and guidance for adjusting an orientation of the wellbore 12 during drilling. Example configurations of the body 64 are not limited to the frusto-conical shape depicted, but include cylindrical, ovoid, an inverted frusto-conical shape, and any configuration for generating pulses across the pulser assembly 42.

Referring now to FIGS. 3A through 3D, alternate embodiments of stators 44A, 44B, 44C are illustrated having elongate lengths extending respectively along axes $A_{SA}$, $A_{SB}$, $A_{SC}$. Stator 44A illustrated in perspective view in FIG. 3A has a generally cylindrically-shaped body 52A and axially extending channels 56A in the body 52A. Each channel 56A of FIG. 3A has an outer radius spaced radially inward from an outer surface of body 52A. Further illustrated is an example of a plug assembly 70A that is selectively inserted into one of the channels 56A for blocking flow through that channel 56A. In a non-limiting example of operation, an area of one of the channels 56A is blocked or reduced without adjusting a total flow rate of the drilling mud DM flowing through stator 44A that increases velocity of drilling mud DM flowing through the remaining channels 56A, and which puts the flow path FP (FIG. 2) in a restricted configuration. The increase in velocity correspondingly increases magnitudes of pressure variations in the mud pulses MP formed when the higher velocity drilling mud DM impinges on the upstream surface of a rotor 46 (FIG. 2) after exiting channel 56A. The example plug assembly 70A of FIG. 3A includes a plug body 72A having a wedge-like cross-section formed complementary to a cross-section of channel 56A. The body 72A has a length $L_B$; examples exist where length $L_B$ is the same, greater than, or less than respective lengths of the channels 56A. It is believed it is within the capabilities of those skilled in the art to determine a velocity of a fluid, i.e. drilling mud, being directed through a mud pulser that is sufficient (a sufficient velocity) for creating pressure pulses in the flow of drilling mud DM that are of adequate magnitude to be detectable downstream of the channel(s) 56A. Moreover, it is further understood it is within the capabilities of those skilled in the art to determine which of the one or more of the channels 56A to be blocked for creating the sufficient velocity.

Figures 3A, 3B, 3C:
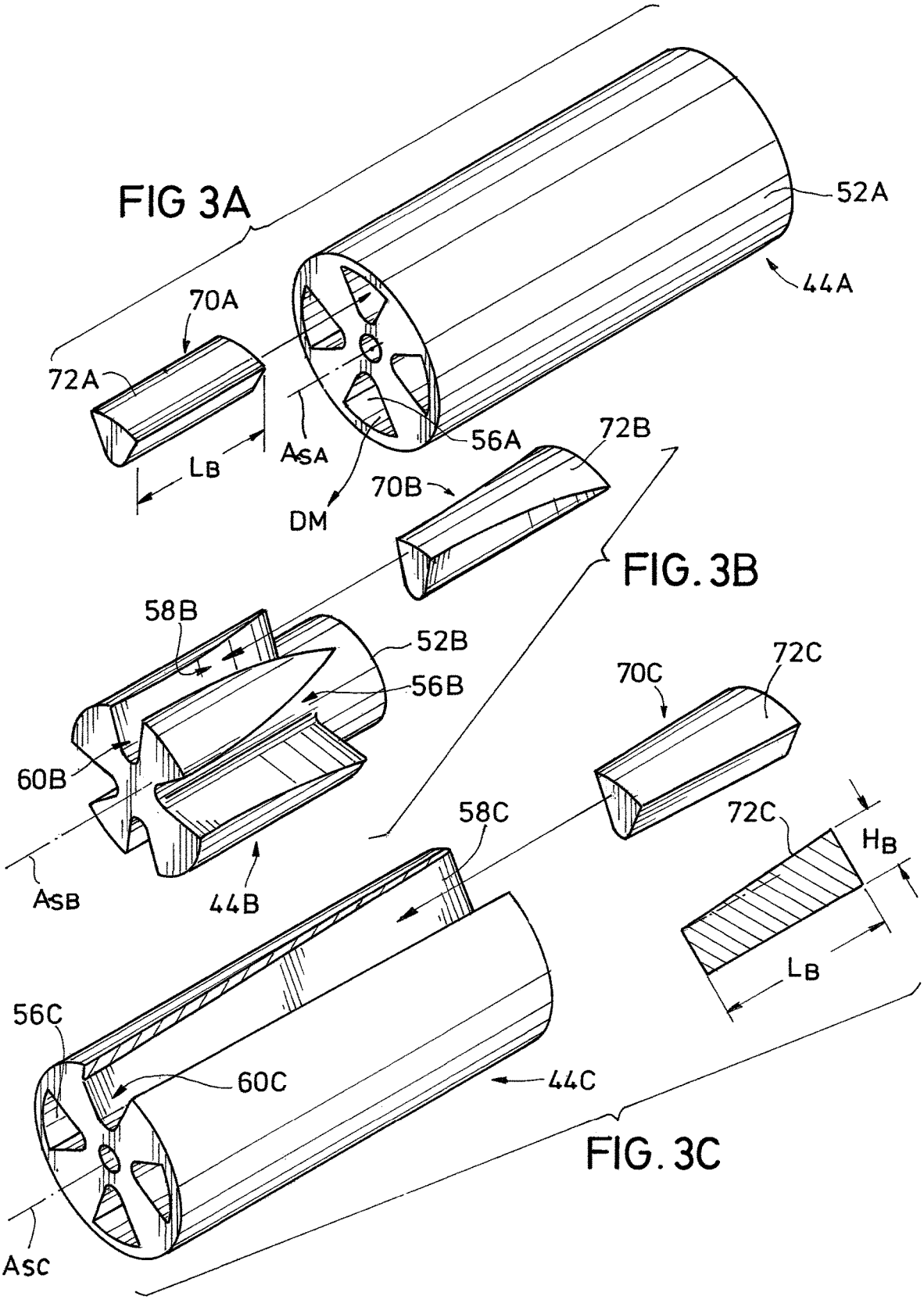
FIGS. 3A-3C and 4 are perspective views of embodiments of stators for use with the mud pulser of FIG. 2.

Alternate examples of the stator 44B, 44C are illustrated in perspective view respectively in FIGS. 3B and 3C. In the example of FIG. 3B, stator 44B is shown having channels 56B with lateral sides that are spaced apart angularly from one another about axis $A_{SB}$, lateral sides follow a generally curved path along their respective radial and axial directions. In the example of FIG. 3B the channels 56B extend radially outward to the outer surface of body 52B, and in the example shown widths of the channels 56B decrease in a direction away from the inlets 58B and towards the outlets 60B. An example of a plug assembly 70B is illustrated with a shape and contour that is substantially complementary to that of the channels 56B, and when selectively inserted into a one of the channels 56B blocks most of or all flow through that particular channel 56B. In the example of FIG. 3C, the body 72C of plug assembly 70C has a height $H_B$ along a direction radial to axis $A_{SC}$ and that increases with respect to the length $L_B$ of body 72C. The increasing height of the body 72C largely matches an increase in height of the channel 56B along a length of the stator 44C. As described above, installing plug assemblies 70A, 70B, 70C into one or more of respective channels 56A, 56B, 56C blocks a flow of drilling mud DM through the channels 56A, 56B, 56C having plug assemblies 70A, 70B, 70C and diverts the drilling mud DM into channels 56A, 56B, 56C without plug assemblies 70A, 70B, 70C ("unplugged channels 56A, 56B, 56C"). In examples in which a flowrate of drilling mud DM is substantially maintained and a plug assembly 70A, 70B, 70C is inserted into one or more of the channels 56A, 56B, 56C increases a flowrate and velocity of the drilling mud DM flowing through the unplugged channels 56A, 56B, 56C and also the stators 44A, 44B, 44C. In a non-limiting example of operation, plug assemblies 70A, 70B, 70C are strategically inserted into one or more of respective channels 56A, 56B, 56C to adjust velocity of the drilling mud DM through the stators 44A, 44B, 44C so that pressure pulses generated in the drilling mud DM are at a threshold level of detection so that the pressure pulses are detectable and recordable by sensor 36 (FIG. 1). In an alternative, pressure pulses in the drilling mud DM that are at a threshold level of detection are at a magnitude that when detected and recorded by sensor 36, the recorded signals are discernable so that substantially all of the data encoded into the fluid by the mud pulser 42A, 42B, 42C is obtained by decoding the detected pressure pulses. With further reference to FIG. 3A, in a non-limiting example plug assembly 70A is employed one or multiple times to selectively block, either totally or partially, one or more channels 56A of the stator 44A. A single plug assembly 70A is optionally used to partially or totally block a single channel 56A, leaving the three remaining channels shown unblocked. In another alternative two plug assemblies 70A are employed, blocking two of the four channels 56A. In this example, an option exists with both plug assemblies 70A either partially or totally blocking the two channels 56A, or the first plug assembly 70A partially blocking one channel 56A with the second plug assembly 70A totally blocking one of the remaining channels 56A. With further reference to FIGS. 3B and 3C, plug assemblies 70B and 70C are optionally employed in a manner similar to that of plug assembly 70A as described above. Examples exist with the axial length of a plug assembly 70A, 70B or 70C ranges from a portion, a substantial portion or a whole of the axial length of a channel 56A, 56B or 56C in the respective stator body 52A, 52B or 52C; or any length(s) between. In an example, two or more plug assemblies are used within a stator body having axial lengths that are the same or different. Alternatively the stator has one, two, three, or four or more channels. In an embodiment of an open configuration the rotor has the same number of open slots as the stator channels. In an alternative embodiment when a channel is plugged the number of rotor slots is equal to the number of remaining open channels. In another example, the rotor has one, two, three, or four or more slots. In a non-limiting example of operation, rotating or rotation of the rotor includes oscillating or oscillation of the rotor. Examples of a restricted configuration includes the cases wherein at least one channel of the stator body is either partially or totally closed, by either the insertion of a plug assembly into the channel, or by the plug assembly defining a barrier outside the channel to the drilling fluid.

Figure 3D:
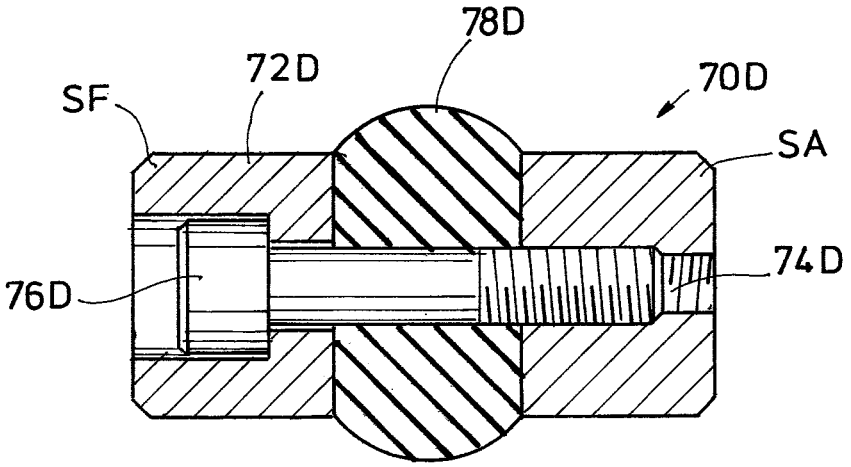
FIG. 3D is a side sectional view of an example of a plug for use with stators of FIGS. 3A-3C.

An alternate example of a plug assembly 70D is depicted in side sectional view in FIG. 3D. In this example body 72D includes forward and aft sections $S_F$, $S_A$ that are separate and spaced apart from one another. A bore 74D axially intersects both the forward and aft sections $S_F$, $S_A$ and which receives a fastener 76D that couples together the forward and aft sections $S_F$, $S_A$. An elastomeric seal 78D is sandwiched between the forward and aft sections $S_F$, $S_A$ and intersected by the fastener 76D. In this example, tightening fastener 76D draws together the two sections of body 72D to axially compress the seal 78D and also cause a mid-portion of the seal 78D to bulge radially outward; which when installed in a channel (not shown) creates a sealing interface along a portion of the channel to block flow through that channel.

Figure 3E:
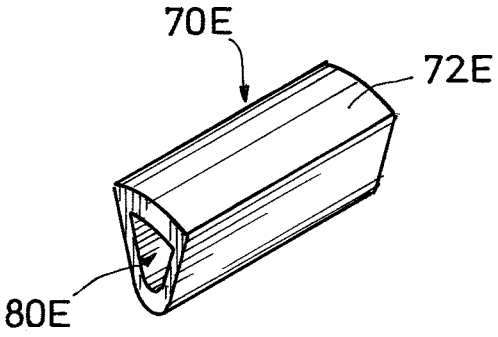
FIGS. 3E and 3F are perspective views of alternate examples of plugs for use with stators of FIGS. 3A-3C.
Figure 3F:
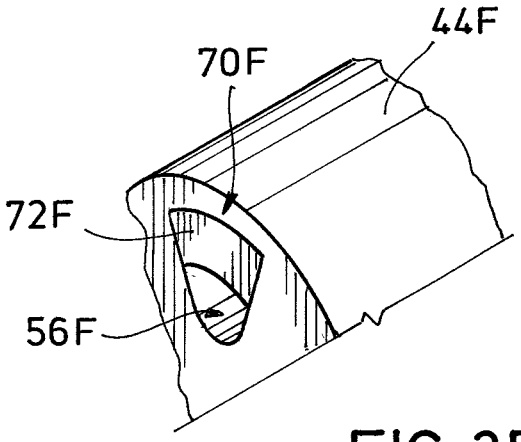

Shown in perspective view in FIGS. 3E and 3F are alternate examples of plug assemblies 70E, 70F with plug bodies 72E, 72F that in examples of use block a portion of a cross-section within a channel 56, 56A-D, 56F when installed therein. In the example of FIG. 3E a passage 80E extends axially through the length of the body 72E. Fluid, such as drilling mud, is selectively directed to and flows through passage 80E, and in an example inserting body 72E into a channel (not shown) reduces flow area without blocking all flow through passage 80E. Similarly, illustrated in FIG. 3F is an example of a plug assembly 70F that is made up of a body 72F that occupies a portion of a cross-sectional area of channel 56F formed axially through a stator 44F.

Figure 4:
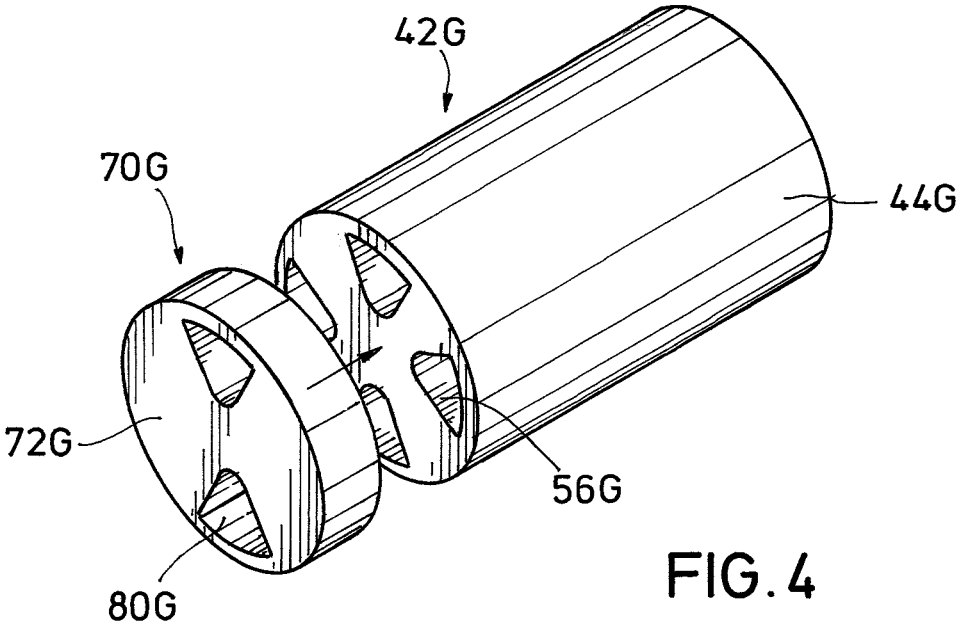

An alternate example of selectively limiting flow through a stator is illustrated in FIG. 4, where plug assembly 70G includes a plug body 72G that is a generally planar disk-like member and includes passages 80G that project axially through the plug body 72G. The plug assembly 70G in this example is constructed for assembly with an example of stator 44G shown with channels 56G that project axially through the stator 44G. In this example the quantity of passages 80G is less than that of channels 56G. In the example of FIG. 4, a portion of a flow area through the stator 44G is selectively blocked by coaxially coupling the plug assembly 70G to an end of stator 44G so that all or a portion of the passages 80G are aligned with channels 56G. Similar to the example described above for encoding pressure pulses with data signals, selective rotation or oscillation of plug body 72G moves passages 80G out of registration with channels 56G when drilling mud DM or other fluid is flowing through the passages 80G to generate a localized increase in pressure in the fluid against plug body 72G, and rotating plug body 72G so that the channel 56G having the fluid with the localized increase in pressure is in registration with a passage 80G, and the fluid with the localized increase in pressure flows past the body 72G.

Figure 5:
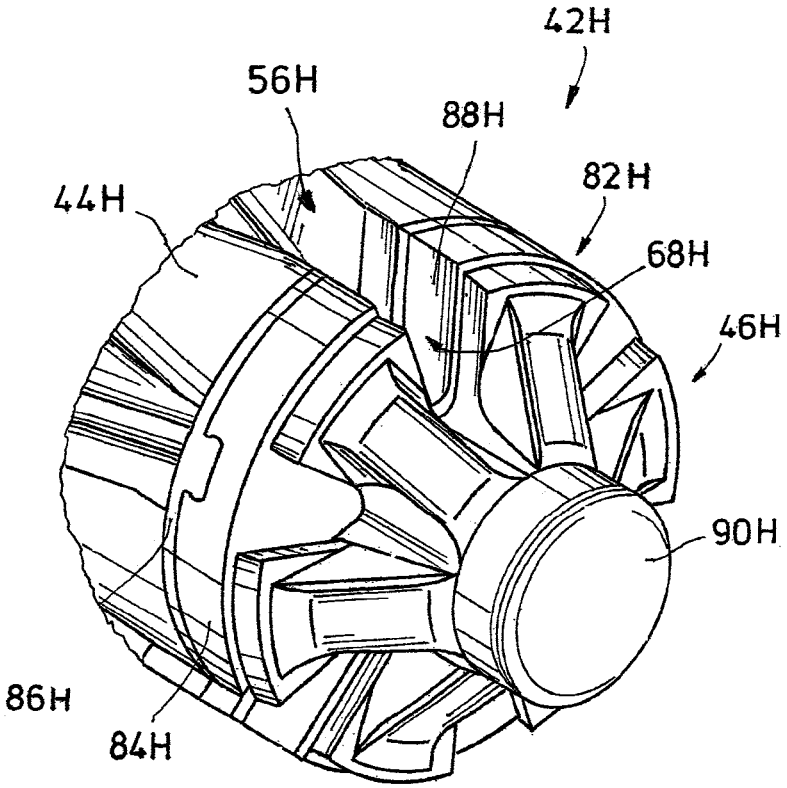
FIG. 5 is a perspective view of an example of a pulser assembly with a flow control system and for use with the mud pulser of FIG. 1.

Referring now to FIG. 5, shown in a perspective view is an example of a pulser assembly 42H. In this example a disk assembly 82H is included with the pulser assembly 42H and which is coaxially disposed between stator 44H and rotor 46H. Disk assembly 82H of FIG. 5 includes a plate 84H and a disk 86H coaxially coupled to a side of the plate 84H that faces stator 44H. Plate 84H and disk 86H are each substantially planar members with generally circular outer perimeters. Plate 84H as shown is axially thicker than disk 86H. In the embodiment illustrated, slots 88H are provided along an outer periphery of the disk assembly 82H that extend axially through the disk assembly 82H at selected angular locations about a circumference of disk assembly 82H. In this example, the number of slots 88H is less than the number of channels 56H within stator 44H. In the illustrated example, the disk assembly 82H defines a barrier to a flow of fluid in at least one of the channels 56H to downstream of the disk assembly 82H, and reduces a cross-sectional area for fluid flow across the pulser assembly 42H that would otherwise be available if all flow through channels 56H were not impeded by disk assembly 82H, and increases a flow velocity of fluid within the unblocked channels 56H. Similar to the pulsing operations described above, one or more mud pulses MP (FIG. 2) are generated in drilling mud DM flowing across pulser assembly 42H by selectively rotating or oscillating rotor 46H to move the slots 68H in and out of registration with channels 56H.

Figure 6A:
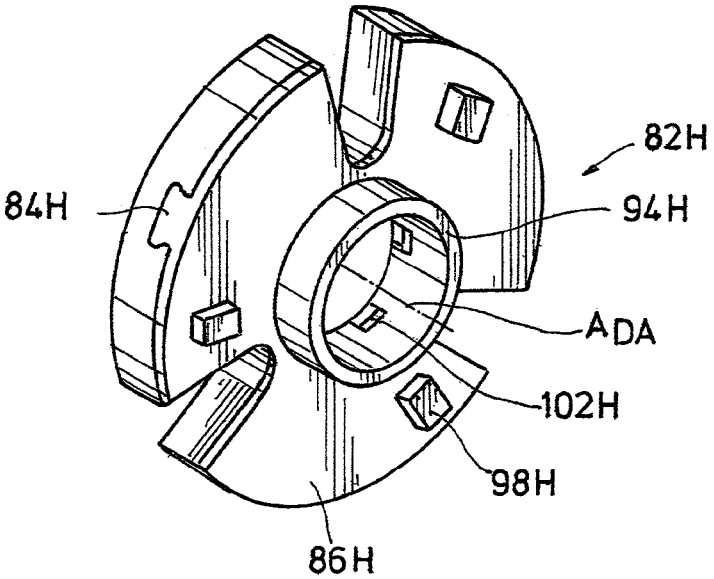
FIG. 6A is a perspective view of an example of a disk assembly for use with the pulser assembly of FIGS. 5 and 6.
Figure 6:
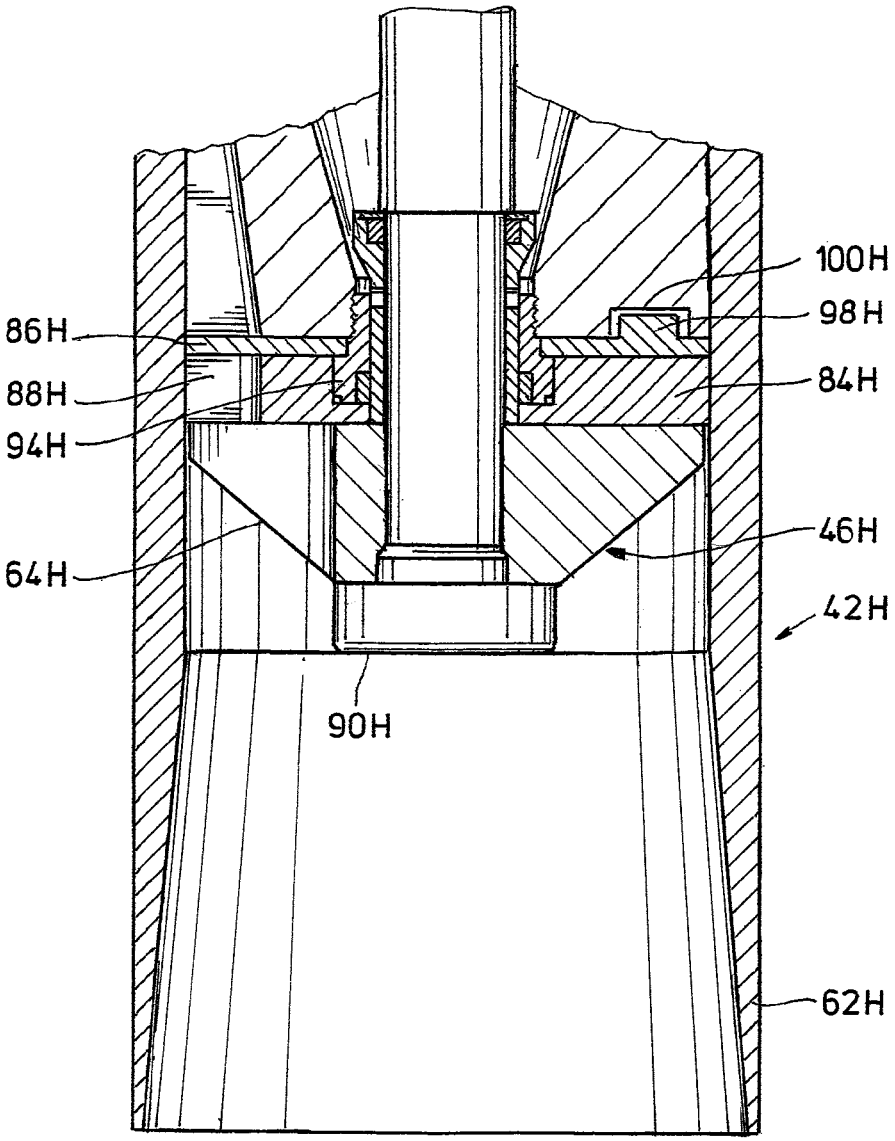
FIG. 6 is a side sectional view of the pulser assembly of FIG. 5.

Illustrated in a side sectional view in FIG. 6 is an example of pulser assembly 42H with sleeve 62H shown circumscribing stator 44H and extending axially past rotor 46H. In this example, a disk-like cap 90H is provided on an axial end of rotor 46H and coupled to the body 64H of rotor 46H Further illustrated in FIG. 6 is an annular clamp ring 94H that is generally coaxial with disk assembly 82H and that provides a way of coupling disk assembly 82H to stator 44H. An outer circumference of the clamp ring 94H is profiled radially inward to define a shoulder and against which an inner circumference of disk 86H is shown in interfering contact. A portion of clamp ring 94H upstream of shoulder projects axially past the disk 86H and couples inside of an end of a bore 96H that is within stator 44H; in the example shown the coupling is via threads, alternatives exist having other coupling means. As shown in perspective view in FIGS. 6 and 6A, tabs 98H project axially from a surface of disk 86H adjacent stator 44H and insert into recesses 100H formed on a surface of stator 44H facing rotor 46H. In this example, disk 86H is rotationally coupled to stator 44H by interfering contact between tabs 98H and recesses 100H. Indentations 102H are shown provided along an inner surface of the clamp ring 94H, and which provide flat surfaces for tools to engage clamp ring 94 for decoupling from stator 44H.

Figure 7A:
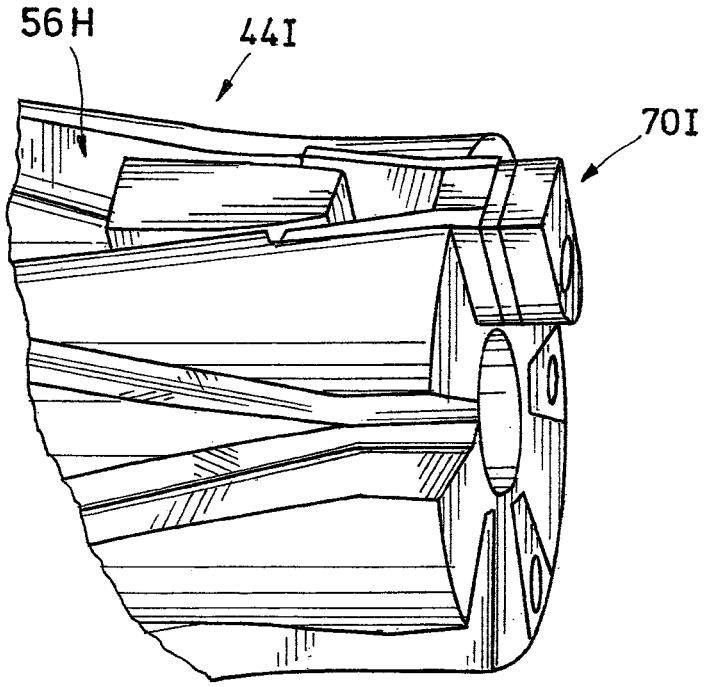
FIGS. 7A and 7C are perspective views of an example of an alternate embodiment of a pulser assembly with a plug assembly and for use with the mud pulser of FIG. 1.
Figure 7B:
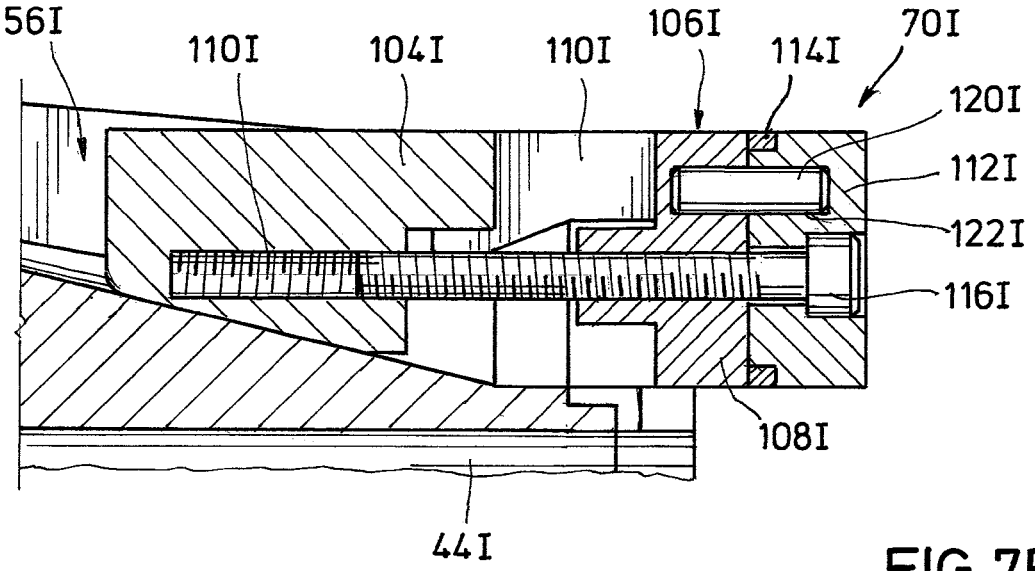
FIG. 7B is a side sectional view of a portion of the pulser assembly and plug assembly of FIG. 7A.
Figure 8A:
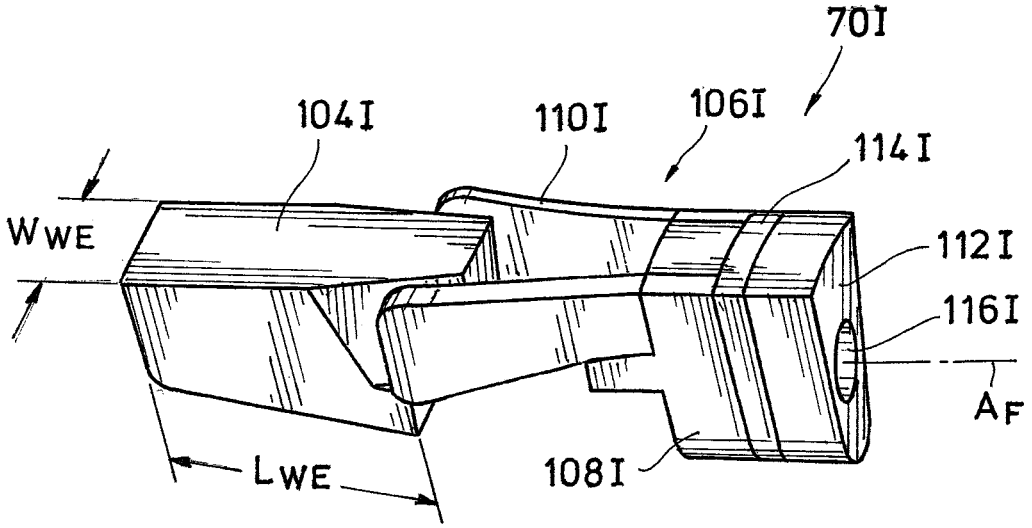
FIGS. 8A and 8B are perspective and exploded views of the plug assembly of FIG. 7A.

Shown in perspective view in FIG. 7A is an alternate example of a plug assembly 70I for use in blocking flow through a channel 56I in stator 44I. Shown in more detail in a side sectional view in FIG. 7B and in perspective view in FIG. 8A, plug assembly 70I includes a wedge 104I which is shown having a length $L_{WE}$, and width $W_{WE}$ that changes with respect to length $L_{WE}$. In this example wedge 104I is a substantially solid member. Also included in plug assembly 70I is a clip member 106I which is made up of a base 108I configured complementary to channel 56I and planar leaf members 110I on opposing lateral sides of base 108I shown depending axially away from base 108I and adjacent sidewalls of channel 56I. In one example of installation provided in FIGS. 7B and 8A wedge 104I is being drawn towards clip member 106I and between leaf members 110I. In this example, leaf members 110I include an elastic material that retains its structural integrity without yielding as the wedge 104I is drawn in a space between leaf members 110I. A front plate 112I is included with the illustrated embodiment, and which is on a side of base 108I opposite from leaf members 110I. A gasket 114I, optionally formed from an elastomeric material, is sandwiched between the front plate 112I and base 108I. In this example, each of the base 108I, front plate 112I, and gasket 114I have an outer periphery with a generally frusto-conical shape and substantially complementary to channel 56I. In an example, a sealing interface is formed between the plug assembly 70I and inner surfaces of channel 56I when plug assembly 70I is assembled. Further included in the example of the plug assembly 70I is an elongated fastener 116I shown extending generally along axis $A_F$. Fastener 116I projects into a bore 118I that intersects each of wedge 104I, clip member 106I, and gasket 114I.

Figure 7C:
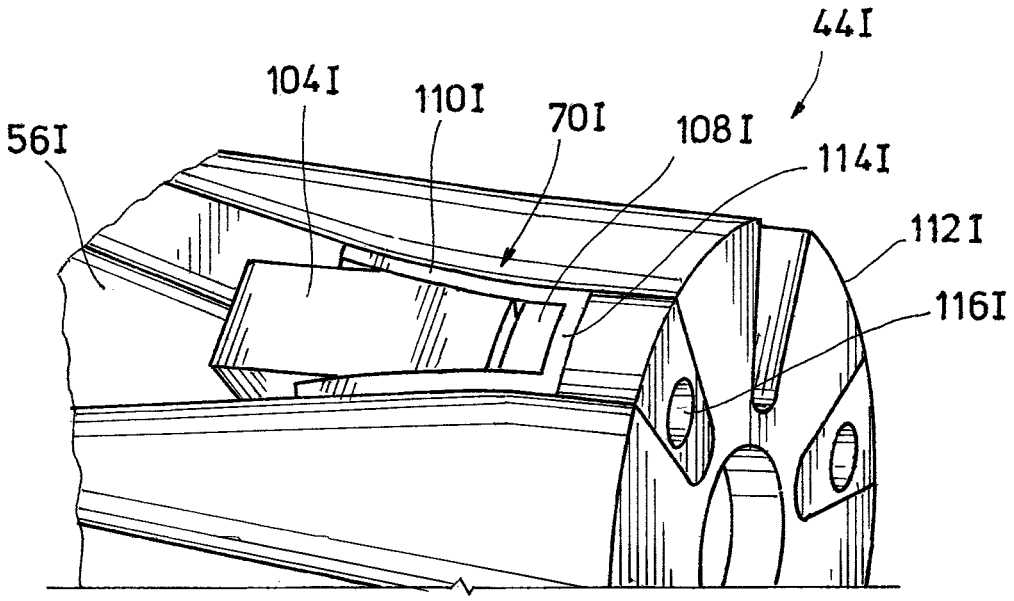
Figure 8B:
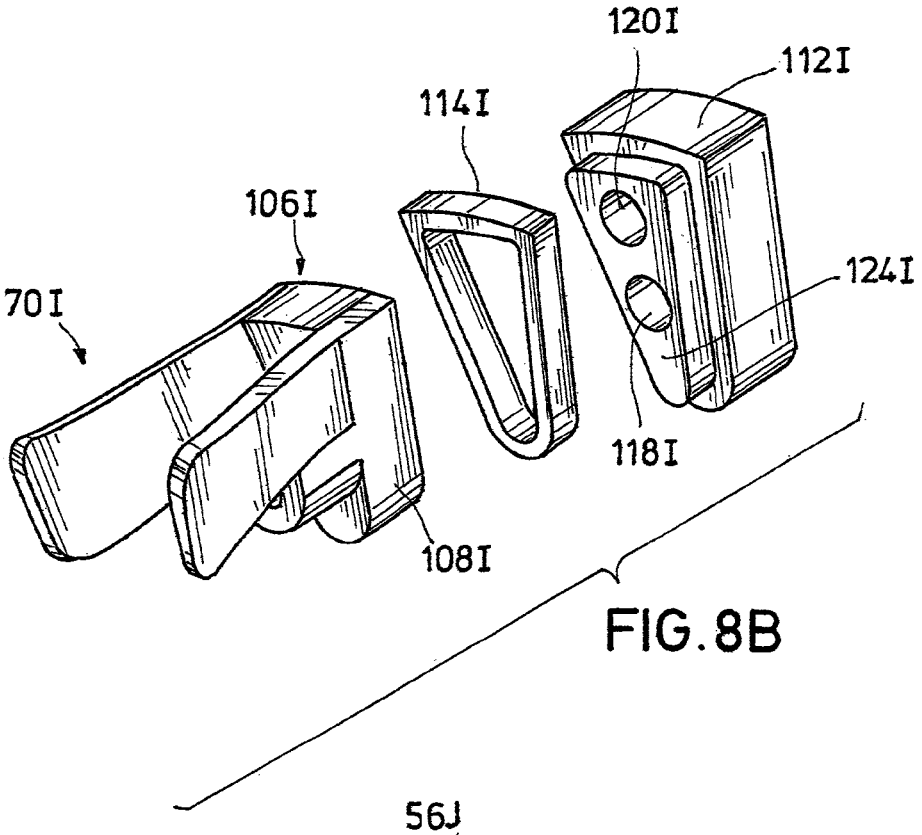

Referring back to FIG. 7B, a pin 120I is disposed within a bore 122I that intersects the front plate 112I and base 108I of clip member 106I. Pin 120I provides a way of coupling together front plate 112I with clip member 106I to reduce unnecessary movement between these members. In one example of operation of installing the plug assembly 70I within channel 56I of stator 44I, continued rotation of fastener 116I draws wedge 104I towards the base 108I, and with the portion of wedge 104I having the larger width $W_{WE}$ between leaf members 110I, urges the opposing disposed leaf members 110I away from each other and against sidewalls of channel 56I. As illustrated in an example of FIG. 7C, an end of wedge 104I is proximate base 108I and gasket 114I is expanded radially outward and into sealing contact with sidewalls of channel 56I. In an example, gasket 114I when expanded is in sealing contact with an inner surface of sleeve (not shown) and blocks flow of fluid through channel 56I. The plug assembly 70I is shown in an exploded view in FIG. 8B depicting gasket 114I as a generally annular member that circumscribes the lateral surfaces of a platform 124I shown projecting axially from on a surface of the front plate 112I facing base 108I, and having a lateral surface set radially inward from that of front plate 112I and base 108I.

Figure 9:
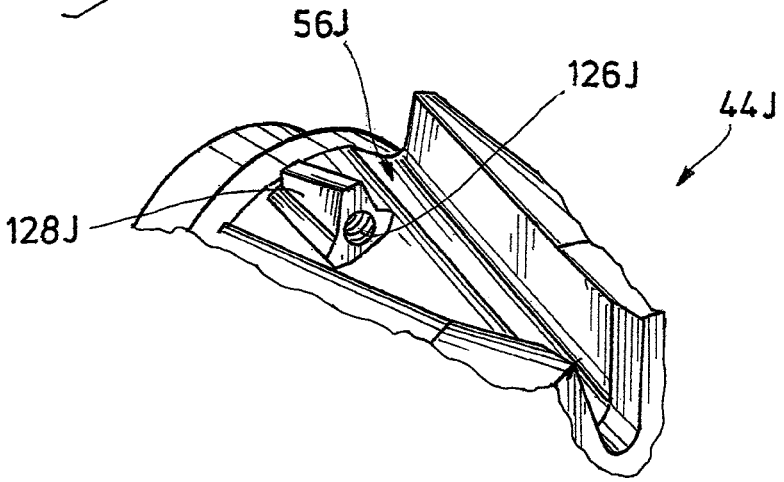
FIG. 9 is a perspective view of an alternate example of the stator of FIG. 2.
Figure 10A:
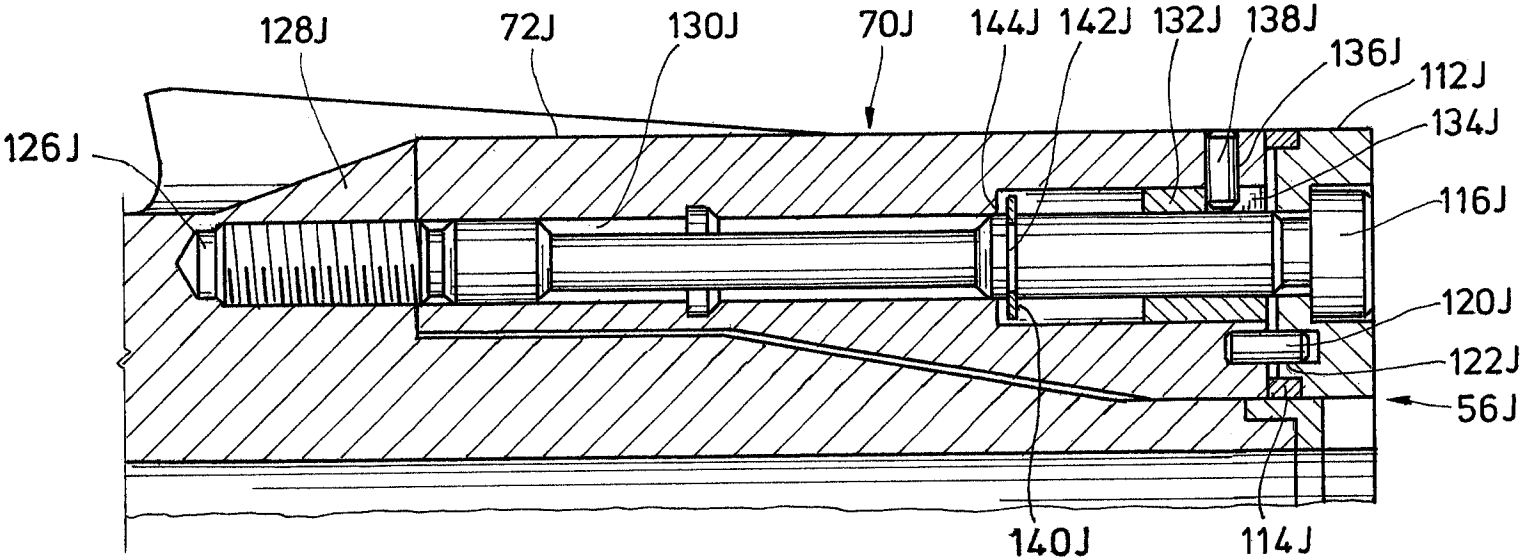
FIG. 10A is a side sectional view of an example of a plug assembly coupled with the stator of FIG. 9.
Figure 10B:
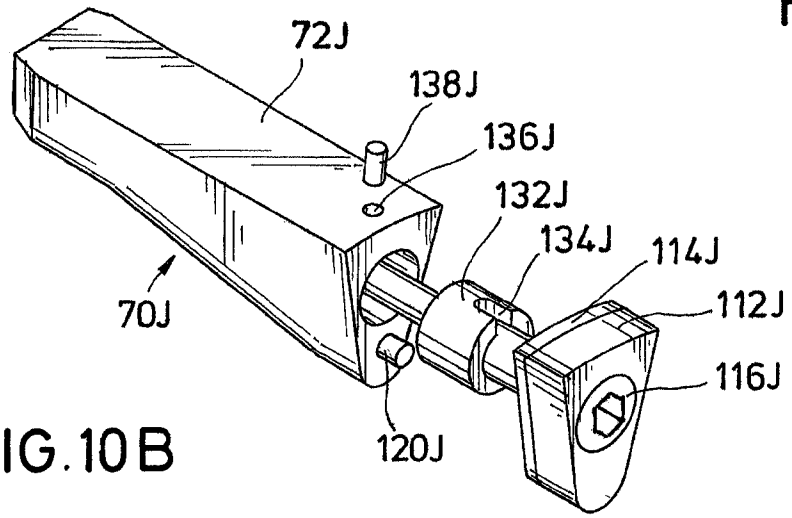
FIG. 10B is a perspective view of the plug assembly of FIG. 10A.

Referring now to FIG. 9, shown in a perspective view in is another alternate example of a stator 44J where a receptacle 126J is formed within a raised projection 128J set within channel 56J. Receptacle 126J includes threads and faces towards a downstream end of stator 44J. Channel 56J is shown in side sectional view in FIG. 10A, and with a portion of an alternate embodiment of a plug assembly 70J inserted in channel 56J. Plug assembly 70J in this example includes an elongated body 72J with an axial bore 130J having a diameter that changes at various locations along its length. Bore 130J is shown in registration with the receptacle 126J, also shown is an elongated fastener 116J that projects through bore 130J and having an end that couples within receptacle 126J; coupling in the example shown is with threads, options include other coupling means. As shown in FIG. 10A and in perspective view in FIG. 10B, the plug assembly 70J also includes an annular stop sleeve 132J that circumscribes a portion of fastener 116J distal from receptacle 126J. A slot 134J is shown formed radially through the sidewall of stop sleeve 132J and along a portion of its axial length. The stop sleeve 132J in the example of FIG. 10A is inserted within bore 130J so that slot 134J is on a side of sleeve 132J facing away from receptacle 126J. A hole 136J shown extending radially through a sidewall of body 72J and adjacent slot 134J, a pin 138J inserted into hole 136J extends into slot 134J. Fastener 116J is axially movable within the stop sleeve 132J. Further illustrated in the embodiment of FIG. 10A is a C-ring 140J that is set into a groove 142J that circumscribes fastener 116J at a location that is between stop sleeve 132J and receptacle 126J. The outer surface of bore 130J projects radially inward at a location proximate the C-ring 140J to define a shoulder 144J that faces away from receptacle 126J. An outer radius of C-ring 140J exceeds an inner radius of stop sleeve 132J, so that a force applied to fastener 116J to slide it and C-ring 140J against a lateral end of stop sleeve 132J also transfers that force, via slot 134J and pin 138J, to body 72J. Accordingly, the addition of the stop sleeve 132J and C-ring 140J provide a means for removing the plug assembly 70J from within receptacle 56J.

The present invention described herein, therefore, is well adapted to carry out the objects and attain the ends and advantages mentioned, as well as others inherent therein. While a presently preferred embodiment of the invention has been given for purposes of disclosure, numerous changes exist in the details of procedures for accomplishing the desired results. For example, alternatives exist in which any of the above described stators include a single channel that selectively receives a plug assembly that when inserted into the single channel blocks less than all of the cross-sectional area of the single channel to define a reduced cross-sectional area in the single channel, and fluid selectively flows through the reduced cross-sectional area in the single channel. These and other similar modifications will readily suggest themselves to those skilled in the art, and are intended to be encompassed within the spirit of the present invention disclosed herein and the scope of the appended claims.

What is claimed is:

1. A system for use in wellbore operations comprising:

a stator selectively disposed in a path of fluid flowing in a drill string and that comprises;

a body; and a flow path intersecting the body, that is in communication with the fluid flowing in the drill string, and that is selectively changed between an open configuration and a restricted configuration;

a rotor comprising a slot, and that is moveable into a first orientation with the slot in registration with the flow path so that the fluid flowing in the drill string flows through the flow path, through the slot, and downstream of the rotor, and the rotor moveable into a second orientation with the slot out of registration with the flow path, so that the fluid flowing in the drill string into the flow path impinges against the rotor and a pressure pulse is created in the fluid in the flow path; and a plug disposed in the flow path when the flow path is in the restricted configuration.

2. The system of claim 1, further comprising channels formed axially through the body, and wherein the flow path comprises branches that each extend through a one of the channels.

3. The system of claim 1, wherein the plug comprises an obstacle to the fluid flowing along the flow path that is selected from a group consisting of an elongated assembly disposed in the flow path, an elongated assembly disposed in a channel that extends through the body, and a disk disposed adjacent the body.

4. The system of claim 1, wherein the rotor is moveable in a rotating motion that is selected from the group consisting of angular rotation, oscillating rotation, and combinations thereof.

5. The system of claim 1, further comprising a sensor that is in communication with the fluid, and that selectively detects the pressure pulse.

6. The system of claim 5, wherein a flowrate of the fluid is at a magnitude so that a pressure pulse that is generated by the fluid flowing downstream of the rotor at a velocity without the restriction is not detectable.

7. A system for use in wellbore operations comprising:

a drill string having a flow of drilling fluid; and a mud pulser in the drill string that is changeable from an open configuration to a restricted configuration and that comprises;

a stator;

channels projecting axially through the stator and that are each in a path of a portion of the flow of drilling fluid;

a rotor having slots that move into and out of registration with the channels with rotation of the rotor; and a plug assembly that when the mud pulser is in the restricted configuration, is selectively positioned to define a barrier to the drilling fluid flowing through at least one of the channels.

8. The system of claim 7, further comprising a sensor that is responsive to pressure pulses in the drilling mud, wherein pressure pulses are generated in the drilling fluid when the slots are out of registration with the channels, wherein pressure pulses generated when the mud pulser is in the open configuration are not detected by the sensor, and wherein pressure pulses generated when the mud pulser is in the restricted configuration are detected by the sensor.

9. The system of claim 7, wherein the plug assembly comprises a disk having slots that are at least partially in selective registration with the at least one of the channels.

10. The system of claim 7, wherein the plug assembly comprises an elongated body that is disposed axially along the at least one of the channels.

11. The system of claim 10, wherein an opening extends axially through the elongated body of the plug assembly and defines a passage through which the drilling fluid flows.

12. The system of claim 11, wherein the opening defines a bore that selectively receives a fastener that engages a receptacle formed in the at least one of the channels, the plug assembly further comprising an annular stop sleeve circumscribing the fastener and coupled to the body, and a C-ring coupled to the fastener between the stop sleeve and the receptacle, so that when the fastener is uncoupled and pulled away from the receptacle, the body is removable from the at least one of the channels by interfering contact of the C-ring with the stop sleeve.

13. The system of claim 10, wherein a cross sectional area of the body varies with respect to a length of the body.

14. The system of claim 7, wherein the plug assembly is laterally expandable into sealing contact with at least one of the channels.

15. The system of claim 14, wherein the plug assembly comprises spaced apart leaf members, a wedge that is selectively drawn into a space between the leaf members, and a fastener coupled with the wedge and the leaf members.

16. The system of claim 7, further comprising a sensor in communication with the drilling fluid and that monitors pressure pulses in the drilling fluid, and a controller in communication with the sensor.

17. A method of wellbore operations comprising:

flowing fluid through a drill string within a wellbore;

inside the drill string directing the fluid to a pressure pulser, the pressure pulser including a rotor, a stator, and a channel formed in the stator, the fluid flowing through the channel;

generating a pressure pulse in the fluid with the pressure pulser;

reducing a flow area of the channel to control a velocity of the fluid flowing through the pressure pulser so that the magnitude of the generated pressure pulse is increased, wherein the step of reducing the flow area comprises adding a plug into the channel;

and detecting the increased pressure pulse.

18. The method of claim 17, wherein adding the plug comprises placing an obstacle into the channel, wherein the obstacle is one of an elongated assembly disposed in the channel, and a disk disposed adjacent the stator.

* * * * *